United States Patent [19]

Johnston

[11] 4,373,766

[45] Feb. 15, 1983

[54] ELECTRICAL CONNECTOR ASSEMBLY

[75] Inventor: James J. Johnston, Old Saybrook, Conn.

[73] Assignee: Connector Technology Corporation, Old Saybrook, Conn.

[21] Appl. No.: 144,830

[22] Filed: Apr. 29, 1980

[51] Int. Cl.[3] ..... H01R 13/54

[52] U.S. Cl. ..... 339/91 R; 339/154 A; 339/176 M

[58] Field of Search ..... 339/91 R, 64 M, 176 R, 339/176 M, 154

[56] References Cited

U.S. PATENT DOCUMENTS 3,369,214 2/1968 Krumreich et al. ..... 331/91 R X
3,617,982 11/1971 Hardesty et al. ..... 339/102 R
3,699,498 10/1972 Hardesty et al. ..... 331/64 M
4,193,654 3/1980 Hughes et al. ..... 331/91 R X
4,273,402 6/1981 Hughes ..... 331/91 R

*Primary Examiner*—Joseph H. McGlynn
*Attorney, Agent, or Firm*—McCormick, Paulding & Huber

[57] ABSTRACT

A plug connector terminating a circuit distribution cable has a housing formed with a cavity containing cantilever spring contacts which terminate externally of the housing. Prestripped end portions of individually insulated conductors which comprise the cable are rigidly supported in slots in an insert and maintained in biased engagement with associated cantilever spring contacts in the housing by the insert which is received within the cavity and retained in snap-in engagement with the housing.

24 Claims, 20 Drawing Figures

FIG. 1
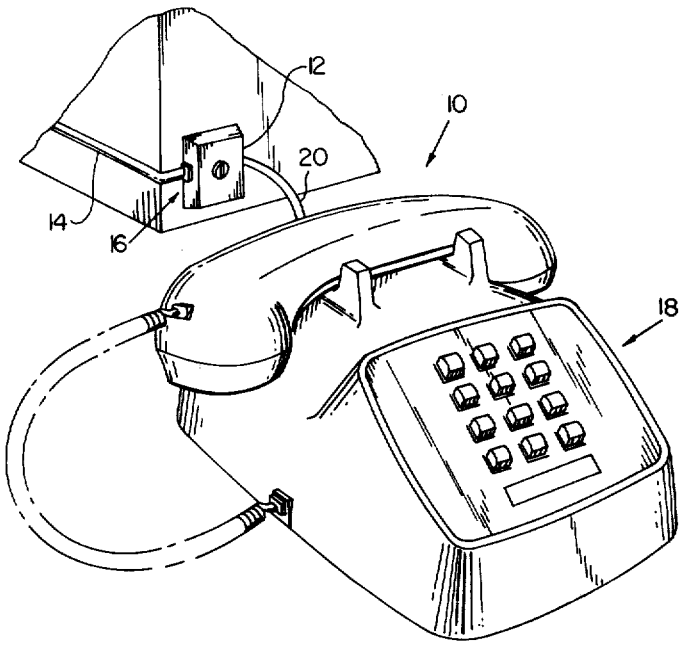
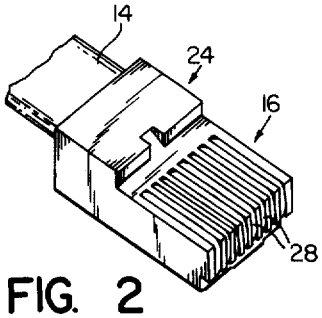
FIG. 2
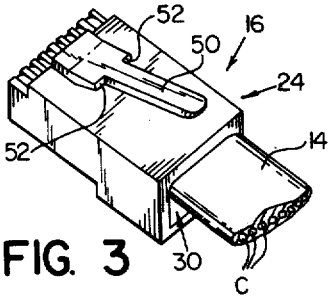
FIG. 3
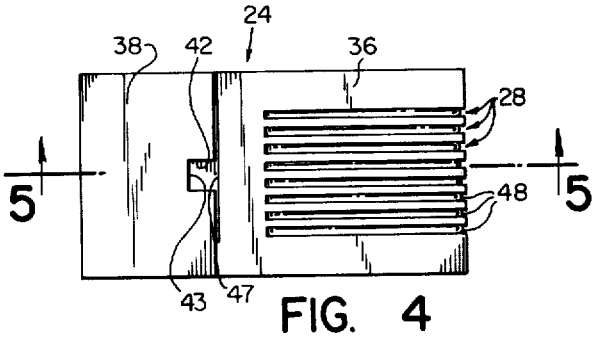
FIG. 4
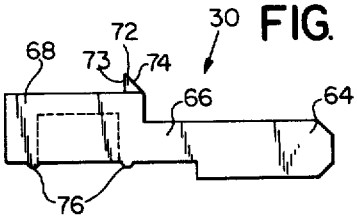
FIG. 8
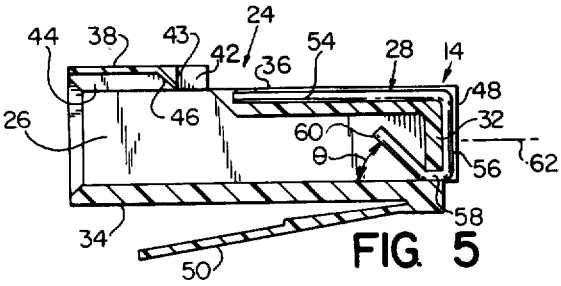
FIG. 5
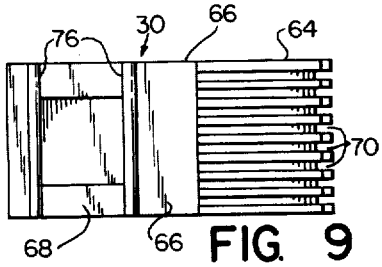
FIG. 9
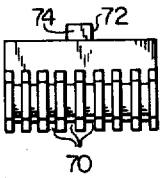
FIG. 10
FIG. 6
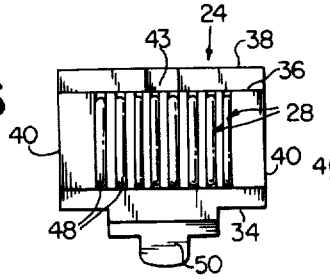
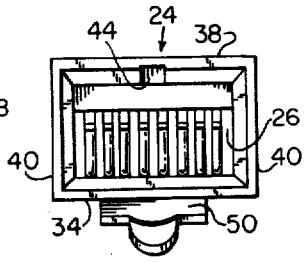
FIG. 7

ELECTRICAL CONNECTOR ASSEMBLY

BACKGROUND OF THE INVENTION

This invention relates in general to electrical connectors and deals more particularly with an improved plug-type connector assembly for terminating a jacketed cable which contains a plurality of individually insulated conductors. The present invention is particularly concerned with improved plug connectors of a type in wide spread use in the telephone industry. Such connectors are frequently used for terminating line cords used between a base and a handset of a telephone and between the base and a wall terminal, for example, and are generally used to terminate tensiled or multiple strand wire. Typical plug connectors of the aforedescribed type are illustrated and described in U.S. Pat. No. 3,617,982, issued Nov. 2, 1971 to Hardesty and U.S. Pat. No. 3,699,498, issued on Oct. 17, 1972 to Hardesty et al.

The development of new electronic telephone sets, such as American Telephone & Telegraph Company DIMENSION and HORIZON key telephone units have created the need for long wire distribution of 2, 3 and 4 pair cables. Long conduit pulls and other hostile installation environments have necessitated the use of standard inside cable construction, namely AWG No. 24 and 26 solid wire conductors. The plug-type connectors illustrated and described in the aforementioned patents utilize terminals having insulation piercing barbs and are not suitable for use with such solid wire conductors. Other known termination methods used in earlier telephone cable distribution systems, such as the insulation displacement concept (IDC) are not generally practical for use on high density connectors, that is connectors having 0.040 inch contact spacing.

Accordingly, it is the general aim of the present invention to provide an improved high density plug-type connector assembly for field termination of solid wire conductors and particularly suitable for use in the telecommunication industry.

SUMMARY OF INVENTION

A connector assembly for terminating a circuit distribution cable or the like having a plurality of solid conductors includes a dielectric housing formed with a cavity opening through one end thereof. A plurality of electrical contacts are mounted in the housing at the end opposite the one end. Each of the contacts has one portion exposed externally of the housing at the one end and another resilient portion disposed within the cavity. An insert received in the cavity maintains a bare end portion of each of the conductors in electrically contacting relation with a respectively associated one of the resilient portions and cooperates with the housing to maintain a portion of the cable in fixed position relative to the plug assembly. A means is provided for retaining the insert in assembled relation with the housing.

BRIEF DESCRIPTION OF THE DRAWINGS

FIG. 1 is a perspective view of a part of a telephone system and shows a plug-type connector assembly which embodies the invention in connected relation with a wall terminal.

FIG. 2 is a somewhat enlarged perspective view of a plug connector assembly embodying the invention.

FIG. 3 is another perspective view of the connector assembly of FIG. 2.

FIG. 4 is a somewhat further enlarged plan view of the connector assembly housing.

FIG. 5 is a sectional view taken along the line 5—5 of FIG. 4.

FIG. 6 is a right end elevational view of the connector assembly housing as oriented in FIG. 5.

FIG. 7 is a left end elevational view of the connector assembly housing.

FIG. 8 is a side elevational view of an insert which comprises a part of the connector assembly.

FIG. 9 is a bottom view of the insert shown in FIG. 8.

FIG. 10 is a right end elevational view of the insert, as it appears oriented in FIG. 8.

DETAILED DESCRIPTION OF PREFERRED EMBODIMENTS

Figure 13:
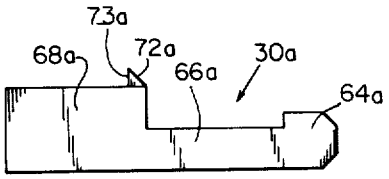
FIG. 13 is a side elevational view of another connector assembly insert embodying the invention.

Turning now to the drawings and referring first to FIG. 1, a telephone system indicated generally at 10 includes a wall terminal 12 connected to an insulated circuit distribution cable 14. The illustrated cable 14 is substantially flat, contains a plurality of individually insulated parallel solid electrical conductors C, C, and is terminated by a plug-type connector assembly indicated generally at 16 and embodying the present invention. The connector assembly 16 is received and releasably retained within an associated jack of conventional type which comprises a part of the wall terminal 12. A telephone set, indicated generally at 18 is connected to the wall terminal 12 in a conventional manner by a flexible line cord 20. The connector assembly 16, shown in FIGS. 2 and 3, generally comprises a housing indicated generally at 24, shown in FIGS. 4–7, and formed with a cavity 26 opening through its rear end. A plurality of resilient electrical terminals indicated generally at 28, 28 and mounted in the housing 24 are exposed at the forward end of the housing and include resilient portions disposed within the cavity 26. The connector assembly 16 further includes an insert 30, shown in FIGS. 8–10. The insert is received within the cavity 26 and maintains bare end portions of each one of the insulated conductors C, C which comprise the distribution cable 14 in electrical contacting relation with a respectively associated one of the resilient portions of the terminals 28, 28, as will be hereinafter further discussed. The illustrated insert 30 is retained in snap-in engagement with the housing 24 and cooperates with the housing to retain an associated portion of the distribution cable in fixed position relative to the connector assembly 16 whereby to provide strain relief for the bare terminal end portions of the various conductors in electrical contact with the terminals 28, 28.

Considering now the connector assembly 12 in detail and further referring to FIGS. 4–7, the housing 24 is preferably made from a dielectric plastic material which can be easily molded by conventional injection-molding techniques. Preferably, and as shown, it is generally rectangular and has a vertically disposed front wall 32, a bottom wall 34, a stepped top wall which includes a front portion 36 and a rear portion 38 vertically offset from the front portion, and a pair of substantially identical side walls 40, 40. The rear edges of the bottom wall 34, the side walls 40 and 40 and the wall portion 38 are camfered and define an inwardly diverging opening for receiving and guiding the insert 30 into the cavity 26, which is defined by the inner surfaces of the front, top, bottom and side walls of the housing 24. An aperture 42 formed in a central part of the rear portion 38 proximate the junction of the front and rear portions 36 and 38 defines a forwardly facing abutment surface 43. A longitudinally extending downwardly and rearwardly opening slot 44 formed in a central part of the rear portion 38 terminates at its forward end in a downwardly and forwardly inclined cam surface 46. The lower end of the cam surface 46 terminates at the lower edge of the abutment surface 43. The front portion 36 is separated from the rear portion 38 along a line of separation indicated at 47 and best shown in FIG. 4. In the forward end of the housing there is formed a plurality of parallel slots 48, 48 which extend vertically across the front wall 32 and open forwardly therethrough. Contiguous portions of the slots 48, 48 extend for some distance through the top wall front portion 36 and open upwardly therethrough.

A resilient latch tab 50 connected to a housing 24 near its forward end by an integral hinge is normally biased to a position wherein it extends rearwardly and downwardly away from the bottom wall 34, as best shown in FIG. 5. The latching tab 50 defines a pair of generally rearwardly facing latching surfaces 52, 52, best shown in FIG. 3.

The electrical terminals 28, 28 are mounted at the forward end of the housing, substantially as shown in FIG. 5, each terminal 28 being mounted within an associated slot 48. The illustrated connector assembly 16 has 8 slots 48, 48, each slot containing an associated contact 28. Each terminal 28 is preferably formed from a piece of resilient phosphor bronze wire which is or may be plated with gold over nickle. A typical terminal 28 has a horizontally disposed portion 54 which is received within a portion of a slot 48 defined by the front portion 36, as shown in FIG. 5. A downwardly bent vertically disposed portion indicated at 56 is received within an associated portion of the slot 48 formed in the front wall 32. A reverse bend portion of the terminal indicated at 58 extends through a hole in the front wall 32 generally adjacent the bottom wall 34 and terminates in a resilient cantilever contact portion 60, disposed within the cavity 26. The contact portion 60 normally forms a 45 degree angle with the bottom wall 34, the latter angle being indicated at $\theta$ in FIG. 5. The end of the terminal portion 54 is trapped in the top wall 36 by the plastic housing material. To assure further contact stability each terminal 28 may be further trapped in the housing front wall 32 by hot stamping the plastic ribs which separate the grooves 48, 48 near the lower portion of the front wall to melt the plastic ribs in a region generally below the broken line 62 of FIG. 5.

The illustrated insert 30, FIGS. 8–10, is particularly adapted for use with the housing 24 to terminate a substantially flat circuit distribution cable, such as the cable 14, which contains 8 parallel solid conductors C, C which are or may be made from soft copper and insulated from each other. The insert 30 is preferably made from dielectric plastic material so that it may be readily formed by a conventional injection-molding process. The insert generally complements portions of the cavity 26 in which it is received and includes a forward end portion 64 which has a generally rectangular cross section generally complementing the cross section of the forward end portion of the cavity 26. An intermediate portion 66 of reduced cross sectional area connects the forward portion 64 to a somewhat larger generally rectangular rear portion 68. A plurality of outwardly opening slots 70, 70 equal in number to the slots 48, 48 are formed in the front, top and bottom walls of the front portion 64 and extend rearwardly for some distance within the top part of the intermediate portion 66. The slots 70, 70 are arranged for registry with the contact portions 60, 60 when the insert 30 is positioned within the housing 24, as will be hereinafter further described.

An integral locking member 72 is formed centrally of the rear portion 66 adjacent its forward edge and extends above the upper surface of the rear portion substantially as shown in FIG. 8. The locking member 72 has a rearwardly facing abutment surface 73 and a generally forwardly facing cam surface 74 which is inclined rearwardly and upwardly from the forward edge of the rear portion 68. A pair of longitudinally spaced apart cable retaining ribs 76, 76 project downwardly from the bottom surface of the rear portion 68 and extend transversely thereacross, as best shown in FIG. 9.

Figure 11:
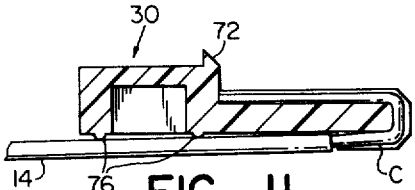
FIG. 11 is a longitudinal sectional view through the insert of FIGS. 8–10 and shows a flat circuit distribution cable in terminating relation to the insert.
Figure 14:
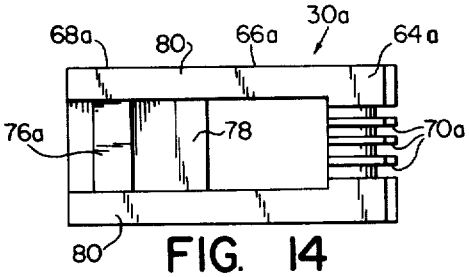
FIG. 14 is a bottom view of the insert shown in FIG. 13.
Figure 12:
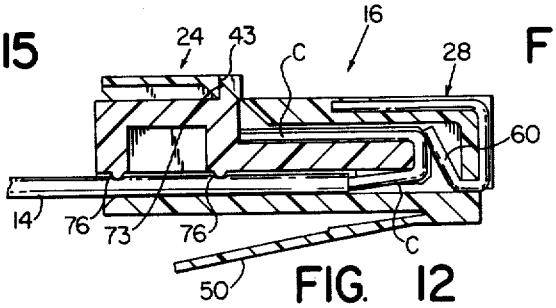
FIG. 12 is similar to FIG. 11 but shows the terminated cable and insert in assembly with a connector assembly housing.

The manner in which the insert 30 is assembled with the housing 24 to terminate a flat cable, such as the illustrated cable 14, will now be considered. Referring now to FIGS. 11 and 12 and first to FIG. 11, an end portion of the cable 14 is first stripped to expose ends of the 8 solid parallel conductors C, C which comprise the cable. The cable is next positioned adjacent the lower surface of the insert 30 and each of the conductors C, C is positioned within an associated slot 70 in the lower wall of the forward portion 64. The soft copper conductors are then bent upwardly into the portions of the slots 70, 70 defined by the forward end of the insert 30. Thereafter the pre-stripped extending end portion of each conductor C is bent rearwardly and downwardly to a position wherein it lies within the portion of an associated slot 70 defined by the intermediate portion 66.

The insert 30 with the cable end portion positioned thereon, substantially as shown in FIG. 11, is now inserted into the cavity 26 through the opening at the rear of the housing 24. The locking member 72 is received within the slot 44. As the insert 30 and the attached cable 14 approach a fully inserted position within the cavity 26 the cam surface 74 on the locking member engages the associated cam surface 46 on the housing. Further forward movement of the insert 30 relative to the housing 24 causes the resilient rear portion 38 to be upwardly bowed whereby to allow the locking member 72 to travel past the cam surface 46. At this point the resilient portion 38 snaps from its bowed condition to its normal or undeformed position bringing the abutment surfaces 43 and 73 into substantial abuting engagement whereby the locking member 72 cooperates with the top wall of the housing 24 to retain the insert 30 and its associated cable end portion in a locked position within the housing 24.

The insert 30 and its associated housing 24 are dimensioned so that the insert 30 moves a bare end portion of each connector C into and maintains it in biased electrical contacting engagement with a respectively associated cantilever contact portion 60. When the insert 30 and the associated end portion of the cable 14 are fully inserted into the housing 24 contact between the bare conductors C, C and the cantilever contact portions 60, 60 causes each spring contact portion 60 to be biased from its normal 45 degree position, indicated at $\theta$ at FIG. 5, to a position wherein it forms an angle of approximately 60 degrees with the lower wall 34, as shown in FIG. 12. This condition represents about two-thirds of the permissible deflection of the contact portion 60 before permanent set occurs and provides substantial stored energy in the contact portion.

It should be further noted that when the insert 30 and the associated end portion of the cable 14 are assembled within the housing 24 longitudinally spaced apart portions of the cable are trapped between the bottom wall 34 and the ribs 76, 76. The ribs form substantial indentations, if not incisions, in the cable jacket in spaced relation to the conductor bare end portions and retain the cable in substantially fixed position relative to the connector assembly 12. This arrangement provides strain relief whereby force applied to the cable in a direction away from the connector assembly will not be transmitted to the bare end portions of the conductors C, C engaged with the contact portions 60, 60.

Figure 19:
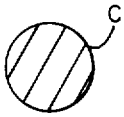
FIG. 19 is a somewhat enlarged cross section through a typical solid electrical conductor which comprises a part of a circuit distribution cable.
Figure 20:
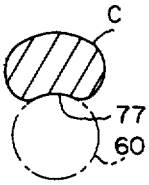
FIG. 20 is similar to FIG. 19, but shows the conductor after deformation by engagement with an associated spring contact.
Figure 18:
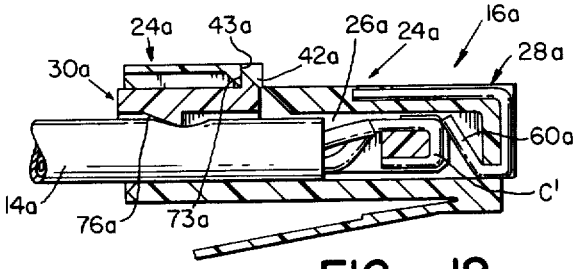
FIG. 18 is similar to FIG. 17 but shows the insert and terminated cable in assembled relation with a connector housing.

The resilient spring contacts 28, 28 are rigidly contained and supported at critical force points within the housing 24. The pre-stripped conductors are presented to the spring contact portions on the dielectric insert form 30 which locks into engagement with the dielectric housing 24. When the hard plated wire contact portions are forced into the mating engagement with the soft unplated copper solid conductors C, C some deformation of the conductors occurs. Before contact each soft conductor C has a generally circular cross section, as shown in FIG. 19. After assembly each soft copper conductor is deformed in its region of contact to a shape substantially as shown in FIG. 20 wherein the general region of contact is indicated at 77. This deformation occurs in a generally axial direction and perpendicular to the diameter of the soft wire conductors and provides a large area of metal to metal contact. The stored energy maintained in the spring contact portions 60, 60 insures sustained high contact pressure. It will be apparent that the termination procedure hereinbefore described utilizing the plug assembly 12 may be readily performed in the field.

Figure 15:
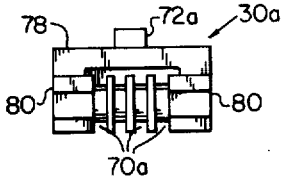
FIG. 15 is a right end elevational view of the insert as it appears in FIG. 13.
Figure 16:
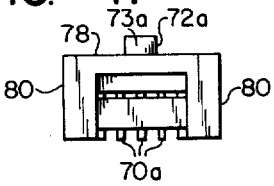
FIG. 16 is the left end elevational view of the insert as it appears in FIG. 13.

Referring now to FIGS. 13–18 another embodiment of the invention is illustrated which is particularly adapted for terminating a line cord or circuit distribution cable **14*a* which has four solid conductors C′, C′ which may be twisted relative to each other. The connector assembly illustrated in FIG. 18 and indicated generally at 16*a* includes a housing 24*a* similar to the housing 24 previously described, but containing only four terminals 28*a*. The connector assembly 16*a* further includes an insert, indicated generally at 30*a* and shown in FIGS. 13–15 which differs somewhat from the corresponding insert 30 previously described. Like the insert 30 the insert 30*a* is configured to be received within the substantially complement associated portions of the cavity 26*a*, however, the insert 30*a* is relieved to receive the cable 14*a*. More specifically, the insert rear portion 68*a* has a generally U-shaped downwardly opening cross section, as best shown in FIG. 16, defined by a top wall 78 and transversely spaced apart side walls 80, 80 which connect the front portion 64*a* to the rear portion 66*a* and define the intermediate portion 64*a*. Contiguous slots 70*a*, 70*a* are formed in the front, top and bottom walls of the front portion 64. A locking member 72*a* substantially identical to the locking member 72, previously described, projects upwardly from the top wall 78 at the forward end of the rear portion 68*a*. An integral strain relieving rib 76*a* projects from the lower surface of the top wall 78 and extends transversely between the side walls 80 and 80. Preferably and as shown, the rib 76*a* terminates at a sharp transversely extending lower edge, as best shown in FIG. 15**.

Figure 17:
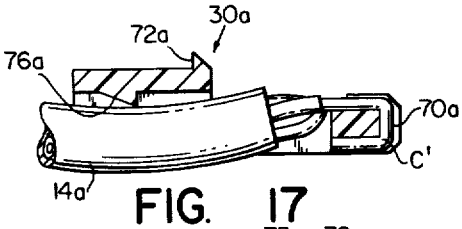
FIG. 17 is a longitudinal sectional view through the insert of FIGS. 13–16 and shows a circuit distribution cable of circular cross section in terminating relation to the insert.

Preparatory to termination, an end portion of the cable **14*a* is stripped to expose bare end portions of the conductors C′, C′. It is preferably, though not essential, that each conductor C′, be stripped to expose a predetermined portion of its length. The insert 30*a* is then positioned to straddle the prestripped cable 14*a*, as shown in FIG. 17. The bare end portion of each conductor C′ is positioned to lie within the upper portion of an associated slot 70*a* after which the conductor is bent downwardly and rearwardly within the slot to the position shown in FIG. 17**.

When the cable has been assembled with the insert, as aforedescribed, the insert and cable subassembly are inserted into the housing to bring the various bare conductors into electrical contacting engagement with the associated cantilever contacts **60*a*, 60*a*. When the insert 30*a* is fully inserted into the housing 24*a* the locking member 72*a* attains a position of snap-in engagement with the locking recess 42*a* so that the forwardly facing abutment surface 43*a* on the housing engages the rearwardly facing abutment surface 73*a* on the locking member 72*a* whereby to positively retain the insert 30*a* and an associated end portion of the cable 14*a* in assembly with the housing 24*a*. The strain relief rib 76*a* cooperates with the lower wall of the housing to trap an associated portion of the cable 14*a* therebetween. The rib 76*a* at least deforms and may in fact incise the cable jacket whereby to restrain an associated portion of the cable spaced from its pre-stripped end in fixed position relative to the connector assembly 12*a***. This arrangement prevents application of direct stress to the terminated bare end portions of the cable in response to pulling force exerted upon the cable and tending to separate it from the connector assembly.

The plug assemblies hereinbefore described are adapted for use with conventional jacks of a type well known in the telecommunication art. The locking tab functions in a conventional manner to releasably retain the connector assembly in connected relation with an associated jack. For a more complete disclosure of a typical locking tab and the manner in which it functions to releasably retain a connector assembly in an associated jack, reference may be had to either the patent to Hardesty or the patent to Hardesty et al hereinbefore identified.

I claim:

1. A connector assembly for terminating an insulated electrical cable including a plurality of electrical conductors having pre-stripped bare end portions without additional structure attached thereto, said connector assembly including a dielectric housing having an axially forwardly extending insert receiving cavity opening through its rear end, a plurality of electrical terminals mounted in said housing, each of said terminals including a portion exposed externally of said housing and a resilient contact portion disposed within said cavity, said contact portion having a normal position within said housing, and insert means at least partially disposed within said cavity for pressing and holding a bare end portion of each one of said conductors without any additional structure attached thereto in direct electrical contacting engagement with a respectively associated one of said resilient contact portions to displace said one resilient contact portion from its normal position to another position within said housing and for cooperating with said housing to maintain an associated portion of the cable spaced from the bare end portions thereof in fixed relation to the connector assembly, said one resilient contact in its other position exerting biasing force directly upon said bare end portion of said one conductor to maintain electrically conducting relation between said one resilient contact and said bare end portion in the absence of any additional terminating structure associated with said bare end portion of said one conductor.

2. A connector assembly as set forth in claim 1 wherein said housing has a plurality of terminal receiving slots in its forward end portion and each of said terminals is received in an associated one of said slots.

3. A connector assembly as set forth in claim 1 wherein each of said terminals comprises an elongated member reversely bent around the forward end of said housing and terminating in a cantilever end portion which defines said resilient contact portion.

4. A connector assembly as set forth in claim 3 wherein the end portion of said member opposite the cantilever end portion is anchored in said housing.

5. A connector assembly as set forth in claim 4 wherein said elongated member comprises a length of spring wire.

6. A connector assembly as set forth in claim 1 wherein said insert means comprises a unitary dielectric insert complementing at least a portion of said cavity and having a plurality of conductor receiving slots in its forward end portion equal in number to and in registry with said resilient contact portions.

7. A conductor assembly as set forth in either claim 1 or claim 5 wherein one of the parts comprising said insert means and said housing includes at least one cable retaining rib projecting from a surface thereof in opposing relation to an associated wall of the other of said parts for cooperating with said associated wall to maintain the associated portion of the cable in fixed relation to the connector assembly.

8. A connector assembly as set forth in claim 7 wherein said insert means comprises said one part and said housing comprises said other part.

9. A connector assembly as set forth in claim 8 wherein the cable has a generally circular cross section, said cavity has a generally rectangular cross section, said insert means comprises an insert having a rear portion defined by a top wall and a pair of side walls and straddling the associated portion of the cable, and said cable retaining rib projects from the lower surface of said top wall.

10. A connector assembly as set forth in claim 1 including means for retaining said insert means in assembly with said housing.

11. A connector assembly as set forth in claim 10 wherein said means for retaining said insert means comprises means for snap-in engagement with said housing.

12. A connector assembly as set forth in claim 10 wherein one of the parts comprising said insert means and said housing has a locking aperture therein defining a forwardly facing first abutment surface and the other of said parts has a locking member thereon received within said aperture and defining a rearwardly facing second abutment surface engaging said first abutment surface when said insert means is assembled with said housing.

13. A connector assembly as set forth in claim 12 wherein said one part comprises said housing and said other part comprises said insert means.

14. A connector assembly as set forth in claim 13 wherein said locking aperture is defined by a resilient wall of said housing and said insert means and said resilient wall have conengageable cam means thereon for biasing said resilient wall away from said insert means in response to insertion of said insert means into said cavity to effect snap engagement of said second abutment surface with said first abutment surface.

15. A connector assembly for terminating an insulated electrical cable including a plurality of electrical conductors having pre-stripped bare end portions without any additional stucture attached thereto, said conductor assembly having a generally rectangular dielectric housing including front, top, bottom and side walls defining a rearwardly opening axially forwardly extending insert receiving cavity of generally rectangular cross section, said top wall having a locking opening therein defining a forwardly facing abutment surface, said top wall having a downwardly and forwardly inclined first cam surface forming a junction at its lower edge with said forwardly facing first abutment surface, said housing having a plurality of terminal receiving slots in its forward end defined by said front wall and said top, a plurality of elongated resilient wire terminals, each of said terminals received in an associated one of said terminal receiving slots and reversely bent around the forward end portion of said housing, each of said terminals having one end portion anchored in said forward end portion, each of said terminals extending through said forward end portion and having another end portion defining a resilient cantilever contact disposed within and having a normal position in said cavity, and insert means at least partially disposed within said cavity for pressing and holding a bare end portion of each one of said conductors without any additional structure attached thereto directly against a respectively associated one of said resilient cantilever contact portions to displace said one resilient cantilever contact portion from its normal position to another position wherein it exerts reactive biasing force directly to said bare end portion of said one conductor, said insert means comprising a unitary dielectric insert generally complementing at least a portion of said cavity, said insert having a front portion defining a plurality of conductor receiving slots equal in number to said terminals and in registry with said contact portions for receiving reversely bent portions of said pre-stripped bare end portions, said insert having a locking member thereon defining a rearwardly facing second abutment surface normally aligned with said first abutment surface and generally forwardly facing cam surface means forming a junction with said second abutment surface and inclined downwardly and forwardly therefrom, said second cam surface means being engageable with said first cam surface when said insert is inserted into said cavity for biasing said top wall away from said insert means to effect snap engagement of said first abutment surface with said second abutment surface whereby to lock said insert in assembly with said housing.

16. A connector assembly as set forth in claim 15 wherein said housing top wall has a forwardly extending and rearwardly and downwardly opening locking slot formed therein for receiving said locking member during assembly of said insert means with said housing and said first cam surface is defined by the forward wall of said locking slot.

17. A connector assembly as set forth in claim 15 wherein said insert means comprises means for retaining an associated portion of the cable spaced from the bare end portions in fixed relation to said connector assembly.

18. A connector assembly as set forth in claim 17 wherein said retaining means comprises a cable retaining rib on one of the parts including said insert and said housing and an opposing wall on the other of said parts.

19. A connector assembly as set forth in claim 18 wherein said one part comprises said insert and said other part comprises said housing.

20. A connector assembly as set forth in claim 19 wherein said insert includes a rear portion having generally U-shaped cross-section for straddling the associated portion of the cable and said rib is carried by said rear portion.

21. A connector assembly for terminating an insulated electrical cable including a plurality of electrical conductors having pre-stripped bare end portions without any additional structure attached thereto, said connector assembly including a dielectric housing having housing front, top, bottom and side walls defining an axially forwardly extending insert receiving cavity opening through its rear end, a plurality of electrical terminals mounted in said housing at the front end portions thereof, each of said terminals including a portion exposed externally of said housing and a resilient contact portion disposed within said cavity, said contact portion having a normal position within said housing, insert means in assembly with said housing at least partially disposed within said cavity for pressing and holding a bare end portion of each one of said conductors without any additional structure attached thereto directly against a respectively associated one of said resilient contact portions to displace said one resilient contact portion from said normal position to another position, said one resilient contact portion in said other position exerting a reactive biasing force directly upon said bare end portion of one conductor to establish electrical contacting relation between said one resilient contact portion and said one connector in the absence of any terminating structure associated with said bare end portion of said one conductor, and means for maintaining said insert means in assembly with said housing.

22. A connector assembly for terminating an insulated electrical cable including a plurality of electrical conductors having pre-stripped bare end portions without any additional structure attached thereto, said connector assembly including a dielectric housing having housing front, top, bottom and side walls defining an axially forwardly extending insert receiving cavity opening through its rear end, a plurality of electrical terminals mounted at the forward end portion of said housing, each of said terminals including an externally exposed portion and a resilient contact portion disposed within said cavity, said contact portion having a normal position within said housing, and insert means at least partially disposed within and extending axially of said cavity for pressing and holding a bare end portion of each one of said conductors without any additional structure attached thereto directly against a respectively associated one of said resilient contact portions and for cooperating with said housing to maintain an associated portion of the cable spaced from the bare end portions thereof in fixed relation to the housing, said one resilient contact portion being displaced from said normal position to another position by direct engagement with said bare end portion of said one conductor, said one resilient contact portion in said other position exerting biasing force directly upon said bare end portion of said one conductor to maintain electrically conducting relation between said bare end portion of said one conductor and said one resilient contact portion in the absence of any terminating structure associated with said bare end portion of said one conductor.

23. A connector assembly as set forth in any one of claims 1, 21 or 22 wherein said resilient contact portion comprises a cantilever portion.

24. A connector assembly as set forth in claim 23 wherein said cantilever portion is inclined to the forwardly extending axis of said insert receiving cavity.

* * * * *